US010260212B2

(12) United States Patent
Zhu et al.

(10) Patent No.: US 10,260,212 B2
(45) Date of Patent: Apr. 16, 2019

(54) SIMPLE METHOD FOR DETERMINING BREAKTHROUGH TIME OF ANTI-SEEPAGE LINERS IN LANDFILL

(71) Applicant: HOHAI UNIVERSITY, Nanjing (CN)

(72) Inventors: Wei Zhu, Nanjing (CN); Shi Shu, Nanjing (CN); Shengwei Wang, Nanjing (CN); Haoqing Xu, Nanjing (CN); Xihui Fan, Nanjing (CN)

(73) Assignee: HOHAI UNIVERSITY, Nanjing (CN)

( * ) Notice: Subject to any disclaimer, the term of this patent is extended or adjusted under 35 U.S.C. 154(b) by 0 days.

(21) Appl. No.: 15/767,651

(22) PCT Filed: Jun. 13, 2017

(86) PCT No.: PCT/CN2017/088034
§ 371 (c)(1),
(2) Date: Apr. 12, 2018

(87) PCT Pub. No.: WO2018/107678
PCT Pub. Date: Jun. 21, 2018

(65) Prior Publication Data

US 2019/0085525 A1 Mar. 21, 2019

(30) Foreign Application Priority Data

Dec. 14, 2016 (CN) ..... 2016 1 1150922

(51) Int. Cl.
*E02D 31/00* (2006.01)

(52) U.S. Cl.
CPC ..... *E02D 31/004* (2013.01); *E02D 31/006* (2013.01); *E02D 2300/0037* (2013.01)

(58) Field of Classification Search
CPC ..... E02D 31/004
(Continued)

(56) References Cited

U.S. PATENT DOCUMENTS 6,599,058 B1 * 7/2003 Arnold ..... B09B 1/00 210/170.07
2010/0266343 A1 * 10/2010 Takahashi ..... B09B 1/00 405/129.85

FOREIGN PATENT DOCUMENTS

CN 202485876 U 10/2012
CN 203833762 9/2014
(Continued)

OTHER PUBLICATIONS

Liangtong Zhan, et al., Parametric study on breakthrough time of vertical cutoff wall for MSW landfills and simplified design formula for wall thickness, Chinese Journal of Geotechnical Engineering, Nov. 30, 2013, vol. 35, No. 11, pp. 1988-1995.

*Primary Examiner* — Eman A Alkafawi
(74) *Attorney, Agent, or Firm* — Gokalp Bayramoglu

(57) ABSTRACT

A method for determining breakthrough time of anti-seepage liners in a landfill, includes (a) detecting a leachate sample of the landfill to determine the initial concentration $C_0$ of pollutants, and monitoring the leachate head h of the landfill; (b) determining the pollution-causing concentration $C_A$ of the pollutants according to functional orientation of local groundwater of the landfill; (c) determining, related parameters of the anti-seepage liners including the thickness z of the anti-seepage liners, the permeability coefficient k of the liners, and the porosity n of the material of the liners, and determining the related parameters of pollutant migration including the effective diffusion coefficient $D_a$* and the mechanical dispersion coefficient $D_m$ of the pollutants in the anti-seepage liners, and the adsorption retardation factor $R_d$ of the anti-seepage liners on the pollutants; and (d) calculating the breakthrough time t of the anti-seepage liners according to a formula,
(Continued)

$$t = \frac{nR_d z^2}{(h+z)k}\left(\left(a\left(\frac{C_0}{C_A}\right)^b\right)\ln\left(\frac{(h+z)k}{n(D_a^* + D_m)}\right) + c\right).$$

3 Claims, 1 Drawing Sheet

(58) Field of Classification Search
USPC ..... 702/2
See application file for complete search history.

(56) References Cited

FOREIGN PATENT DOCUMENTS

| | | | |
|---|---|---|---|
| CN | 104863184 | A | 8/2015 |
| CN | 106677227 | A | 5/2017 |
| DE | 4009387 | C1 | 10/1991 |

* cited by examiner

SIMPLE METHOD FOR DETERMINING BREAKTHROUGH TIME OF ANTI-SEEPAGE LINERS IN LANDFILL

CROSS REFERENCE TO RELATED APPLICATIONS

This application is national phase entry of international application PCT/CN2017/088034, filed on Jun. 13, 2017, which claims priority to Chinese Patent Application No. CN 201611150922.6, filed on Dec. 14, 2016, which is hereby incorporated by reference in its entirety.

TECHNICAL FIELD

Belonging to the field of anti-seepage in a landfill, the present invention relates to a method for calculating breakthrough time of anti-seepage liners, and in particular, to a simple method for determining breakthrough time of anti-seepage liners in a landfill.

BACKGROUND

Currently, the global annual production of municipal solid waste amounts to about 10 billion tons, among which the annual production of municipal solid waste in China amounts to 250 million tons and rapidly grows at a rate of 8% to 15% each year; and landfill is still a major method for disposal of municipal solid waste in most of the countries including China. There are 100,000 and 150,000 landfills in the U.S. and Europe respectively, and China has more than 20,000 landfills. The existence of a large number of landfills brings a huge risk of environmental disasters, among which groundwater pollution caused by leakage and breakthrough of landfill leachate from anti-seepage liners is one of the most common pollution disasters.

The breakthrough of leachate from anti-seepage liners actually refers to seepage of pollutants in the leachate from the bottom of the anti-seepage liners after a long time of migration and dispersion with permeation of the leachate. When the seepage concentration of the pollutants gradually increases and reaches the harm-causing or pollution-causing concentration, groundwater and surrounding environment will be polluted. Therefore, breakthrough time of anti-seepage liners in a landfill is crucial in environmental safety assessment of the landfill. However, a landfill system is rather complex, concerning factors such as the thickness of anti-seepage liners, the permeability coefficient of the liners, the leachate head of the landfill, and the porosity of the material of the liners, which bring a heavy load to design, management, subsequent repairing and other work of the landfill.

SUMMARY

An objective of the present invention is to eliminate the defects in the prior art and provide a simple method for determining breakthrough time of anti-seepage liners in a landfill.

To achieve the above objective, the technical solution adopted by the present invention is: a simple method for determining breakthrough time of anti-seepage liners in a landfill. The method includes the following steps:

(a) detecting a leachate sample of the landfill to determine the initial concentration $C_0$ (mg/L) of typical pollutants, and monitoring the leachate head h (m) of the landfill;

(b) determining the harm-causing or pollution-causing concentration $C_A$ (mg/L) of the pollutants according to functional orientation of local groundwater of the landfill;

(c) determining, through researches, related parameters of the anti-seepage liners and related parameters of pollutant migration, the related parameters of the anti-seepage liners including the thickness z (m) of the anti-seepage liners, the permeability coefficient k (m/s) of the liners, and the porosity n (–) of the material of the liners; and the related parameters of pollutant migration including the effective diffusion coefficient $D_a^*$ ($m^2/s$) and the mechanical dispersion coefficient $D_m$ ($m^2/s$) of the pollutants in the anti-seepage liners, and the adsorption retardation factor $R_d$ (–) of the anti-seepage liners on the pollutants; and (d) calculating the breakthrough time t of the anti-seepage liners according to a formula (1):

$$t = \frac{nR_d z^2}{(h+z)k}\left(\left(a\left(\frac{C_0}{C_A}\right)^b\right)\ln\left(\frac{(h+z)k}{n(D_a^* + D_m)}\right) + c\right), \tag{1}$$

where a, b, c are state coefficients independently.

Preferably, in Step (a), the initial concentration $C_0$ (mg/L) of the typical pollutants is detected according to the Chinese National Standard GB 5750-2006*: Standard examination methods for drinking water.*

Preferably, in Step (a), the leachate head h (m) of the landfill is monitored according to the Chinese Industry Standard CJJ 176-2012*: Technical code for geotechnical engineering of municipal solid waste sanitary landfill.*

Preferably, in Step (b), the harm-causing or pollution-causing concentration $C_A$ (mg/L) of the pollutants is the limiting concentration of the pollutants in different quality classifications that are specified in GB/T 14848-93*: Quality standard for ground water* or GB 3838-2002*: Environmental quality standards for surface water.*

Preferably, a is 0.2899, b is –0.1343, and c is –0.01094.

By using the above technical solution, the present invention has the following advantages as compared with the prior art. According to the simple method for determining breakthrough time of anti-seepage liners in a landfill provided by the present invention, the breakthrough time is calculated by using the formula (1) after parameters such as the initial concentration $C_0$ of the pollutants and the harm-causing or pollution-causing concentration $C_A$ of the pollutants are determined, which satisfies the requirements on the accuracy of engineering design. Moreover, the method does not need a great deal of on-site monitoring or complex calculation, has a low cost, is simple and easy to carry out, and is quick and effective. The method can be widely applied to design, management, subsequent repairing and other work of anti-seepage liners in a landfill.

DETAILED DESCRIPTION

Preferred embodiments of the present invention are described in detail below.

A simple method for determining breakthrough time of anti-seepage liners in a landfill provided by the present invention includes the following steps:

(a) detecting a leachate sample of the landfill to determine the initial concentration $C_0$ (mg/L) of typical pollutants, and monitoring the leachate head h (m) of the landfill, where the initial concentration $C_0$ of the typical pollutants is detected according to the Chinese National Standard GB 5750-2006*: Standard examination methods for drinking water*; the leachate head h of the landfill is monitored according to the Chinese Industry Standard CH 176-2012*: Technical code for geotechnical engineering of municipal solid waste sanitary landfill;*

(b) determining the harm-causing or pollution-causing concentration $C_A$ (mg/L) of the pollutants according to functional orientation of local groundwater of the landfill, where the harm-causing or pollution-causing concentration $C_A$ of the pollutants is the limiting concentration of the pollutants in different quality classifications that are specified in GB/T 14848-93*: Quality standard for ground water* or GB 3838-2002*: Environmental quality standards for surface water;*

(c) determining, through researches, related parameters of the anti-seepage liners and related parameters of pollutant migration, the related parameters of the anti-seepage liners including the thickness z (m) of the anti-seepage liners, the permeability coefficient k (m/s) of the liners, and the porosity n (–) of the material of the liners; and the related parameters of pollutant migration including the effective diffusion coefficient $D_a$* ($m^2$/s) and the mechanical dispersion coefficient $D_m$ ($m^2$/s) of the pollutants in the anti-seepage liners, and the adsorption retardation factor $R_d$ (–) of the anti-seepage liners on the pollutants; and (d) calculating the breakthrough time t of the anti-seepage liners according to a formula (1):

$$t = \frac{nR_d z^2}{(h+z)k}\left(\left(a\left(\frac{C_0}{C_A}\right)^b\right)\ln\left(\frac{(h+z)k}{n(D_a^* + D_m)}\right) + c\right), \tag{1}$$

where a, b, c are state coefficients independently, a is 0.2899, b is −0.1343, and c is −0.01094.

Figure 1:
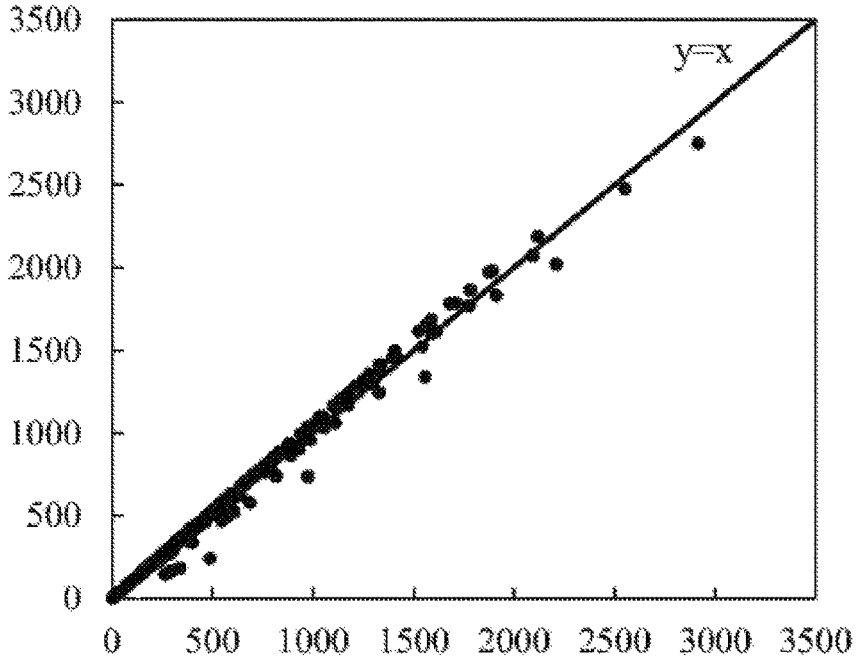
FIG. 1 is a comparison diagram of breakthrough time of anti-seepage liners in a landfill according to the present invention against calculated values obtained by using an analytical solution.

For points in FIG. 1, x-coordinates represent breakthrough time of anti-seepage liners in different working conditions that is obtained by using a conventional analytical solution, and y-coordinates represent breakthrough time of anti-seepage liners in corresponding working conditions that is calculated by using the formula (1). The points are basically close to the line y=x, and the correlation coefficient $R^2$ of a fitting formula reaches 0.997, which indicates that the calculation accuracy of the formula (1) is still very high.

In addition, taking 2–m compacted clay anti-seepage liners that are commonly used in a landfill for example, the breakthrough time of organic matters (COD) in different leachate head conditions that is calculated by using the present invention is compared with the breakthrough time obtained by finite-element calculation.

TABLE 1

Parameters related to compacted clay anti-seepage liners in a landfill and parameters related to pollutant migration

| Leachate head h (m) | 0.3 | 2 | 5 | 8 | 10 |
|---|---|---|---|---|---|
| The thickness z (m) of liners | | 2 | | | |
| The permeability coefficient k (m/s) of liners | | $1 \times 10^{-9}$ | | | |
| Porosity (–) | | 0.54 | | | |
| Pollutants | | COD | | | |
| Diffusion coefficient $D_a$* ($m^2$/s) | | $2.5 \times 10^{-10}$ | | | |
| Dispersity α (m)* | | 0.1 | | | |
| Retardation factor (–) | | 3.3 | | | |

*Note: the dispersity α is used to calculate the dispersion coefficient $D_m$ ($m^2$/s):

$$D_m = \alpha \cdot v_A = \frac{(h+z)k\alpha}{nz}, \tag{2}$$

where $v_A$ is average velocity (m/s).

Figure 2:
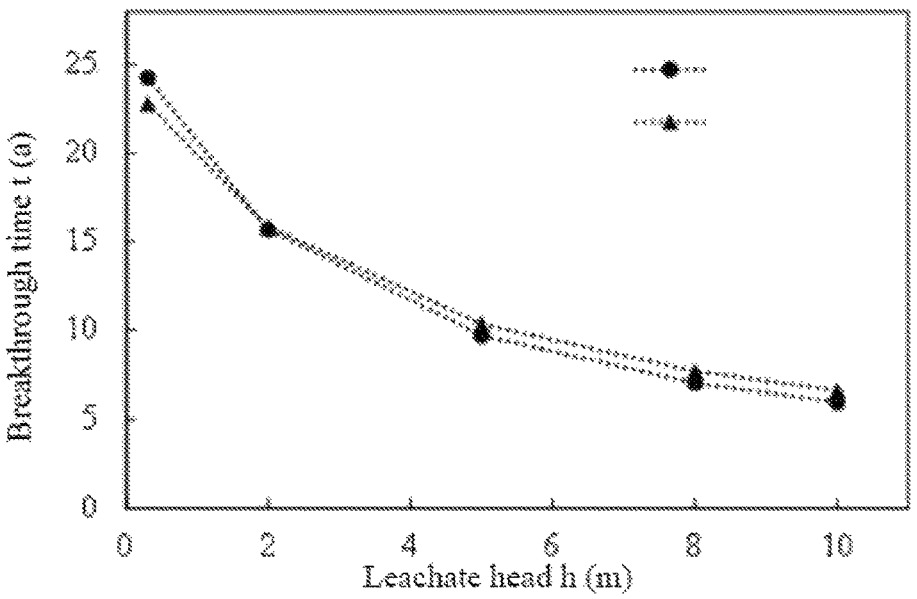
FIG. 2 is a comparison diagram of breakthrough time of 2–m compacted clay anti-seepage liners according to the present invention against finite-element calculated values.

For points in FIG. 2, horizontal coordinates represent leachate heads, vertical coordinates represent breakthrough time of 2–m compacted clay liners, the breakthrough time calculated by using a finite-element method is marked with solid dots, and the breakthrough time in corresponding working conditions that is calculated by using the formula (1) is marked with solid triangles. It is found by comparison that, the results of the two calculation methods are very close, which also indicates that the calculation accuracy of the formula (1) is very high.

The above embodiment merely illustrates the technical idea and features of the present invention, aiming to make persons skilled in the art learn about the content of the present invention and implement the present invention accordingly, and is not intended to limit the protection scope of the present invention. Any equivalent variations or modifications made based on the spirit of the present invention shall fall within the protection scope of the present invention.

What is claimed is:

1. A method for determining breakthrough time of anti-seepage liners in a landfill, comprising the following steps:

(a) detecting a leachate sample of the landfill to determine an initial concentration $C_o$ of pollutants, and monitoring a leachate head h-of the landfill;

(b) determining a harm-causing or pollution-causing concentration $C_A$ of the pollutants according to a functional orientation of local groundwater of the landfill;

(c) determining, related parameters of the anti-seepage liners and related parameters of pollutant migration, the related parameters of the anti-seepage liners comprising the thickness z of the anti-seepage liners, a permeability coefficient k of the anti-seepage liners, and a porosity n of a material of the anti-seepage liners; and the related parameters of pollutant migration comprising an effective diffusion coefficient $D_a$* and a mechanical dispersion coefficient $D_m$ of the pollutants in the anti-seepage liners, and an adsorption retardation factor $R_d$ of the anti-seepage liners on the pollutants; and (d) calculating the breakthrough time t of the anti-seepage liners according to a formula:

$$t = \frac{nR_d z^2}{(h+z)k}\left(\left(a\left(\frac{C_0}{C_A}\right)^b\right)\ln\left(\frac{(h+z)k}{n(D_a^* + D_m)}\right) + c\right)$$

where a, b, c are state coefficients independently.

2. The method for determining breakthrough time of anti-seepage liners in a landfill according to claim 1, wherein in step (a), the initial concentration $C_o$ of the pollutants is detected.

3. The method for determining breakthrough time of anti-seepage liners in a landfill according to claim 1, wherein a is 0.2899, b is −0.1343, and c is −0.01094.

* * * * *